US007013617B2

(12) United States Patent
Garrett

(10) Patent No.: US 7,013,617 B2
(45) Date of Patent: Mar. 21, 2006

(54) METHOD OF FILLING AND SEALING

(75) Inventor: Michael Ernest Garrett, Woking (GB)

(73) Assignee: The BOC Group, plc, Windelsham (GB)

( * ) Notice: Subject to any disclaimer, the term of this patent is extended or adjusted under 35 U.S.C. 154(b) by 0 days.

(21) Appl. No.: 10/699,131

(22) Filed: Oct. 31, 2003

(65) Prior Publication Data

US 2005/0050849 A1 Mar. 10, 2005

Related U.S. Application Data

(63) Continuation-in-part of application No. 09/718,856, filed on Nov. 22, 2000, now abandoned, which is a continuation-in-part of application No. 09/283,551, filed on Apr. 1, 1999, now abandoned.

(51) Int. Cl.
*B65B 31/00* (2006.01)

(52) U.S. Cl. ..... 53/403; 53/408; 53/477; 53/95; 53/101

(58) Field of Classification Search ..... 53/454, 53/467, 453, 403, 477, 408, 97, 95, 98, 99, 53/106, 101, 109; 72/325
See application file for complete search history.

(56) References Cited

U.S. PATENT DOCUMENTS 636,317 A 11/1899 Von Bühler
2,335,799 A 11/1943 Schwab
2,503,171 A 4/1950 Posner
2,837,880 A 6/1958 Rosenblatt et al.
3,141,225 A 7/1964 Watson
3,374,126 A * 3/1968 Lingenfelter ..... 148/521
3,785,025 A 1/1974 Wolf
3,789,689 A 2/1974 Mace
4,204,378 A 5/1980 Thompson
4,287,746 A 9/1981 Thompson
4,727,233 A 2/1988 Pavese et al.
5,159,799 A 11/1992 Rising et al.
5,221,311 A 6/1993 Rising et al.
5,358,288 A 10/1994 Lindner et al.
5,546,783 A * 8/1996 Fischer et al. ..... 72/325

FOREIGN PATENT DOCUMENTS

WO WO 94/24263 10/1994

* cited by examiner

*Primary Examiner*—Rinaldi I. Rada
*Assistant Examiner*—Christopher Harmon
(74) *Attorney, Agent, or Firm*—Philip H. Von Neida

(57) ABSTRACT

A method of filling and sealing a gas capsule having (i) a hollow body portion and (ii) an elongate hollow neck portion having a free open distal end extending from the body portion is disclosed. The method is accomplished by applying a filling cap to the open end of the neck portion while evacuating the capsule and refilling with helium. Two crimping steps while pressure is maintained finishes the filling and sealing method.

4 Claims, 1 Drawing Sheet

METHOD OF FILLING AND SEALING

This application is a continuation-in-part of U.S. patent application Ser. No. 09/718,856 filed Nov. 22, 2000, now abandoned which application is a continuation-in-part of U.S. patent application Ser. No. 09/283,551 filed Apr. 1, 1999, now abandoned.

BACKGROUND OF THE INVENTION

The present invention relates to a method of filling and sealing a gas capsule, particularly a gas capsule of a kind that holds a discrete volume of pressurised gas at high pressure, say, between 30 bar and 80 bar.

Sealed gas capsules are well known for use in circumstances where the force of the gas, typically carbon dioxide, under pressure is employed to dispense a substance such as draught beer from a beer dispenser or soda water from a soda siphon. Such capsules have a body portion and a neck portion, the latter typically being provided with a seal which is able to be broken so as to release the gas.

It is also known to employ such sealed gas capsules containing helium at high pressures in medical devices using the energy of the pressurised helium to drive a therapeutic agent through the skin of a patient. The storage of helium presents particular problems in view of its high fugacity.

In PCT published application WO94/24263 there is described a needle-less syringe, which includes a metal capsule containing helium gas at high pressure which is used to force particles of a therapeutic agent through the skin of a patient in a substantially painless manner. The capsule is detachable from the remainder of the syringe and once used, either a new charge of gas can be placed in the capsule or more favourably the capsule can be discarded and a new capsule charged with gas can be attached to the remainder of the syringe.

In the circumstance where the gas capsule is a "throw away" item it is important that it can be manufactured simply and cheaply. In medical applications helium gas is a favoured fluid since it is very light which makes it suitable for use as a propellant for therapeutic agents in that when it impinges against the skin of a patient it will bounce off into the atmosphere and not pass through the skin of the patient. However, helium because it is light, is difficult to contain since it will leak through the most minuscule fault in a container.

U.S. Pat. No. 4,727,233 relates to the sealing of metal tubes, particularly of stainless steel, for example, tubes that are used to fill containers of gas at high pressure. In the method according to U.S. Pat. No. 4,727,233, once a predetermined quantity of gas has been supplied to the container, the latter is sealed by the cutting and sealing of the tube through which it is filled. The following procedure is adopted. A pair of main jaws which carry so-called presser nibs are operated to squash part a chosen portion of the tube. A pair of auxiliary jaws which also carry presser nibs are detachably engaged to the main jaws. Accordingly, operation of the main jaws causes the auxiliary jaws to squash the rest of the chosen portion of the tube. The squashing of the chosen portion of the tube is carried out in such a manner so as to achieve a completely sealed constriction of the tube. If desired, a bush may be pre-inserted in the chosen portion of the tube so as to facilitate the formation of this seal. The auxiliary jaws are then disengaged from the main jaws and taken away so as to free part of the squashed part of the tube, while the remaining part of the squashed portion remains under the clamping pressure exerted by the main jaws. The tube is then severed, for example, by means of cutting blades, at the freed part of the squashed portion to form an end having lips. The lips are then welded, for example, by plasma-arc welding.

The procedure set out in U.S. Pat. No. 4,727,233 has a number of disadvantages. First, the need to disengage the auxiliary jaws from the main jaws and then to sever the tube adds considerably to the length of time required to perform the entire sealing operation and therefore makes it unsuitable for use in industrial production when the tubes are required on a continuous basis. Second, the cutting of the tube may create small particles of metal that may interfere with the subsequent welding process or even become trapped in the lips making possible their subsequent release under pressure if the sealed gas container is to be opened by puncturing the weld. Such release of metal particles could be injurious to a patient if the gas is employed for the transcutaneous delivery of a pharmaceutical.

SUMMARY OF THE INVENTION

It is an aim of the present invention to provide a method of filling and sealing a gas capsule with helium at a pressure of at least 30 bar.

According to the present invention, a method of filling and sealing a gas capsule having (i) a hollow body portion and (ii) an elongate hollow neck portion having a free open distal end extending from the body portion, comprising the sequential steps of:

a) applying in a fluid tight manner a filling cap to the free open distal end of the neck portion, initially evacuating the hollow body portion via the filling cap and subsequently filling the hollow body portion with helium under a pressure of at least 30 bar;

b) with the filling cap still in place and pressure still applied to the helium, making a first crimp in the elongate hollow neck portion at a portion spaced from the open distal end of the neck portion, the first crimp preventing significant leakage from the hollow body portion of the capsule past the first crimp when the filling cap is removed;

c) removing the filling cap thereby revealing again the free distal end of the elongate hollow neck portion; and d) applying a second crimp at or immediately adjacent the free distal end of the elongate hollow neck portion, thereby creating a chamber between the first and second crimps;

and also comprising the additional step of welding the free distal end of the elongate hollow neck portion at substantially the same time as the second crimp is formed and thereby hermetically sealing the capsule without severing the hollow elongate neck portion.

Preferably the fluid is helium at a pressure of at least 30 bar, and the capsule is formed of aluminium or an aluminium alloy.

BRIEF DESCRIPTION OF THE DRAWINGS

An embodiment of the invention will now be described by way of example, reference being made to the Figures of the accompanying diagrammatic drawing in which.

DETAILED DESCRIPTION OF THE PREFERRED EMBODIMENTS

As shown, a capsule 1 comprises a hollow cylindrical body portion 2 made, for example, from aluminium or an aluminium alloy from which extends an elongate hollow neck portion 4 of smaller diameter than the body portion 2. Initially the neck portion 4 has an open free distal end 6.

Figure 1:
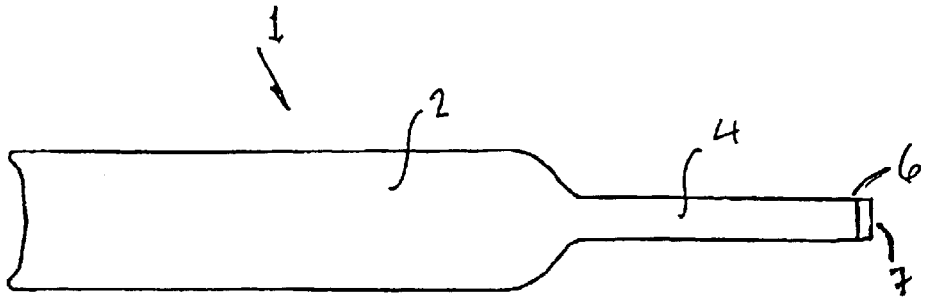
FIG. 1 is a plan view of a capsule for containing a fluid under pressure.
Figure 2:
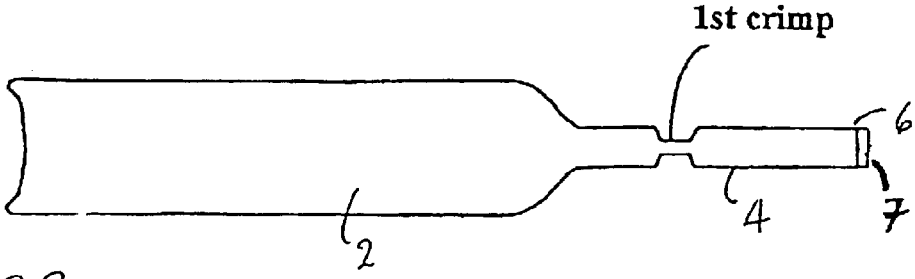
FIG. 2 is a view similar to FIG. 1 but showing a first crimp applied to a neck portion of the capsule.

When it is desired to fill the capsule 1 with helium under pressure, a filling cap 7 is applied in a manner known per se to the free distal end 6 of the neck portion 4. A vacuum is applied at the filling cap 7 to evacuate the hollow cylinder body portion 2 after which the body portion 2 is filled with the helium under pressure. With the filling cap 7 still in place over the free distal end of the neck portion 4 and pressure still applied to the fluid within the body portion 2, the elongate hollow neck portion 4 is crimped at a location spaced from said free end 6 (see FIG. 2). This crimp is made sufficiently firm to avoid significant leakage of fluid from the body portion 2.

Figure 3:
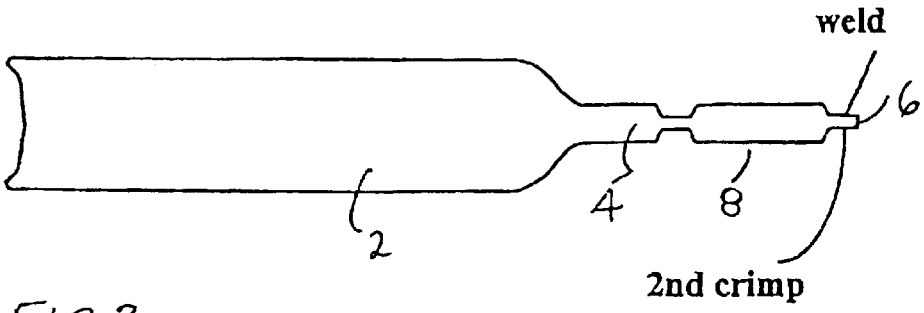
FIG. 3 is similar to FIGS. 1 and 2 but showing a second crimp applied to the neck portion according to the present invention.

The filling cap 7 is then removed from the free distal end 6 of the neck portion 4 to reveal said free distal end 6. Immediately said free end 6 is revealed then a second crimp is applied (see FIG. 3) at or immediately adjacent said free distal end 6 and at substantially the same time the free distal end 6 is laser welded to seal hermetically the end of the neck portion 4.

The purpose of the first crimp is to prevent fluid under pressure from reaching the second crimp and thus the free distal end 6 so that the laser weld can be made without gas permeation holes. Effectively, the two crimps define an interim chamber which prevents or inhibits fluid under pressure reaching the point where the free distal end 6 of the neck portion 4 is to be welded.

The crimps can be effected with either a circular swage type crimp or a simple flat crimp.

When the capsule is to be used in connection with a needleless syringe then the fluid will be helium at a pressure of at least 30 bar.

The method according to the invention enables the weld to be made at the distal free end 7 of the elongate hollow neck portion 4. In consequence, no severing of the neck portion 4 is performed at any time during the filling and sealing procedure.

Having thus described the invention, what I claim is:

1. A method of filling and sealing a gas capsule having (i) a hollow body portion and (ii) an elongate hollow neck portion having a free open distal end extending from the body portion, comprising the sequential steps of:

a) applying in a fluid tight manner a filling cap to the free open distal end of the neck portion, initially evacuating the hollow body portion via the filling cap and subsequently filling the hollow body portion with helium under a pressure of at least 30 bar;

b) with the filling cap still in place and pressure still applied to the helium, making a first crimp in the elongate hollow neck portion at a portion spaced from the open distal end of the neck portion, the first crimp preventing significant leakage from the hollow body portion of the capsule past the first crimp when the filling cap is removed;

c) removing the filling cap thereby revealing again the free distal end of the elongate hollow neck portion; and d) applying a second crimp at or immediately adjacent the free distal end of the elongate hollow neck portion, thereby creating a chamber between the first and second crimps;

and also comprising the additional step of welding the free distal end of the elongate hollow neck portion at substantially the same time as the second crimp is formed and thereby hermetically sealing the capsule without severing the hollow elongate neck portion.

2. The method of claim 1, wherein the said capsule is made from aluminium or an aluminium alloy.

3. The method of claim 1, when said step of welding is a step of laser welding.

4. The method of claim 1, wherein the said pressure is greater than 30 bar and less than 80 bar.

* * * * *